US009769568B2

(12) United States Patent
Layton et al.

(10) Patent No.: US 9,769,568 B2
(45) Date of Patent: Sep. 19, 2017

(54) SYSTEM AND METHOD FOR SPEECH REINFORCEMENT

(71) Applicant: 2236008 Ontario Inc., Waterloo (CA)

(72) Inventors: Leonard Charles Layton, Vancouver (CA); Phillip Alan Hetherington, Port Moody (CA); Shreyas Paranjpe, Vancouver (CA)

(73) Assignee: 2236008 Ontario Inc., Waterloo, Ontario (CA)

( * ) Notice: Subject to any disclaimer, the term of this patent is extended or adjusted under 35 U.S.C. 154(b) by 5 days.

(21) Appl. No.: 14/975,077

(22) Filed: Dec. 18, 2015

(65) Prior Publication Data

US 2016/0183025 A1 Jun. 23, 2016

Related U.S. Application Data

(60) Provisional application No. 62/095,510, filed on Dec. 22, 2014.

(51) Int. Cl.

| | |
|---|---|
| ***H04R 27/00*** | (2006.01) |
| ***H04R 5/02*** | (2006.01) |
| ***H04R 3/12*** | (2006.01) |
| ***H04R 1/40*** | (2006.01) |
| *H04S 7/00* | (2006.01) |

(52) U.S. Cl.

CPC ..... *H04R 3/12* (2013.01); *H04R 1/403* (2013.01); *H04R 2203/12* (2013.01); *H04R 2499/13* (2013.01); *H04S 7/302* (2013.01); *H04S 2420/01* (2013.01)

(58) Field of Classification Search

CPC ..... H04R 3/12; H04R 1/403; H04R 2208/12; H04R 2499/13; H04S 7/302; H04S 2420/01

See application file for complete search history.

(56) References Cited

U.S. PATENT DOCUMENTS

2005/0141723 A1 6/2005 Lee et al.
2005/0271213 A1 12/2005 Kim
2015/0016643 A1* 1/2015 Steffens ..... H04S 7/30 381/307

FOREIGN PATENT DOCUMENTS

WO WO 2009/012499 A1 1/2009
WO WO 2013/144269 A1 10/2013

OTHER PUBLICATIONS

European Search Report for corresponding European Application No. 15201780.2 dated Mar. 24, 2016, 7 pages.

* cited by examiner

*Primary Examiner* — Regina N Holder

(74) *Attorney, Agent, or Firm* — Brinks Gilson & Lione

(57) ABSTRACT

A system and method for speech reinforcement may determine the spatial location of an audio source and the spatial location of a listener. An audio signal generated by the audio source may be captured. The spatial location, relative to the listener, of two or more audio transducers that emit a reinforcing audio signal to reinforce the audio signal may be determined. The captured audio signal, responsive to the spatial location of the audio source, the spatial location of the listener and the spatial location of the two or more audio transducers to generate the reinforcing audio signal, such that, when emitted by the two of more audio transducers, the listener perceives a source of the reinforcing audio signal to be spatially located in substantially the spatial location of the audio source thereby reinforcing the audio signal.

33 Claims, 8 Drawing Sheets

SYSTEM AND METHOD FOR SPEECH REINFORCEMENT

PRIORITY CLAIM

This application claims the benefit of priority from U.S. Provisional Application No. 62/095,510, filed Dec. 22, 2014, which is incorporated by reference.

BACKGROUND

Technical Field

The present disclosure relates to the field of processing audio signals. In particular, to a system and method for speech reinforcement.

Related Art

In-car communication (ICC) systems may be integrated into an automobile cabin to facilitate communication between occupants of the vehicle by relaying signals captured by microphones and reproducing them in audio transducers within the vehicle. For example, a speech signal received by a microphone near a driver is fed to an audio transducer near third row seats to allow third row occupants to hear the driver's voice clearly. Delay and relative level between a direct speech signal and a reproduced sound of a particular talker at a listener's location are important to ensure the naturalness of conversation. Reproducing the driver's voice in audio transducers situated in close proximity to the occupants may cause the occupants to perceive the driver's voice originating from both the driver's spatial location and from the spatial location of the audio transducers. In many cases, the perception of the driver's voice coming from two different spatial locations may be distracting to the occupants.

BRIEF DESCRIPTION OF DRAWINGS

The system and method may be better understood with reference to the following drawings and description. The components in the figures are not necessarily to scale, emphasis instead being placed upon illustrating the principles of the disclosure. Moreover, in the figures, like referenced numerals designate corresponding parts throughout the different views.

Other systems, methods, features and advantages will be, or will become, apparent to one with skill in the art upon examination of the following figures and detailed description. It is intended that all such additional systems, methods, features and advantages be included with this description and be protected by the following claims.

DETAILED DESCRIPTION

A system and method for speech reinforcement may determine the spatial location of an audio source and the spatial location of a listener. An audio signal generated by the audio source may be captured. The spatial location, relative to the listener, of two or more audio transducers that emit a reinforcing audio signal to reinforce the audio signal may be determined. The captured audio signal may be used to generate, responsive to the spatial location of the audio source, the spatial location of the listener and the spatial location of the two or more audio transducers, the reinforcing audio signal such that, when emitted by the two of more audio transducers, the listener perceives a source of the reinforcing audio signal to be spatially located in substantially the spatial location of the audio source thereby reinforcing the audio signal.

Figure 1:
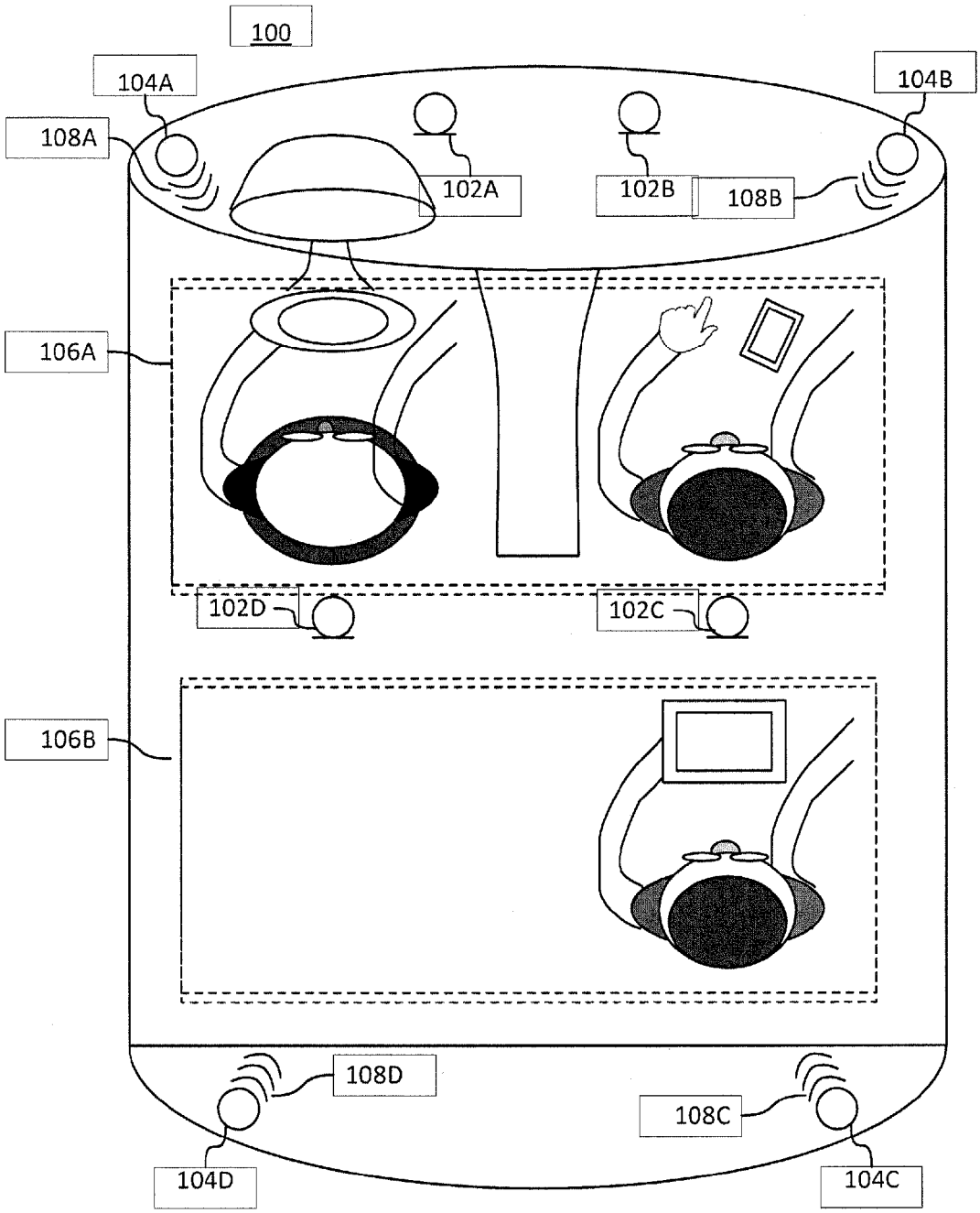
FIG. 1 is a schematic representation of an overhead view of an automobile in which a system for speech reinforcement may be used.

FIG. 1 is a schematic representation of an overhead view of an automobile in which a system for speech reinforcement may be used. The example automobile cabin 100 may include multiple audio transducers 104A, 104B, 104C and 104D (collectively or generically audio transducers 104) and multiple microphones 102A, 102B, 102C and 102D (collectively or generically microphones 102). One or more of the audio transducers 104 may emit audio signals 108A, 108B, 108C and 108D (collectively or generically audio signals 108). Audio signals may be captured by one or more of the microphones 102. The captured audio signals, using the one or more microphones 102, may include, for example, voices from persons in the automobile cabin 100, the audio signals 108, time-delayed and reverberant energy associated audio signals 108, music from an integrated entertainment system, alerts associated with vehicle functionality and many different types of noise. The automobile cabin 100 may include a front seat zone 106A and a rear seat passengers' zone 106B (collectively or generically the zones 106). Other zone configurations are possible that may include, for example, a driver's zone, a front passenger zone and a third row rear seat passengers' zone (not shown).

An in-car communication (ICC) system may be integrated into the automobile cabin 100 that facilitates communication between occupants of the vehicle by relaying signals captured by one or more of the microphones 102 and reproducing them in the audio transducers 104 within the vehicle. For example, an audio signal captured by a microphone 102 near the driver's mouth may be fed to an audio transducer 104 near the third row to allow third row occupants to hear the driver's voice clearly. The ICC system may improve the audio quality associated with a person located in a first zone communicating with a person located in a second zone. Reproducing the driver's voice may result in a feedback path that may cause ringing; this may be mitigated by, for example, controlling a closed-loop gain. Delay and the relative amplitude level between a direct speech signal and a reproduced sound of a particular talker at a listener's location may also affect the naturalness of conversation. The ICC system may also be referred to as a sound reinforcement system. The sound reinforcement system may be used, for example, in large conference rooms with speakerphones and in audio performances at venues such as concert halls. The sound reinforcement system may also be used in other types of vehicles such as trains, aircraft and watercraft.

Figure 2:
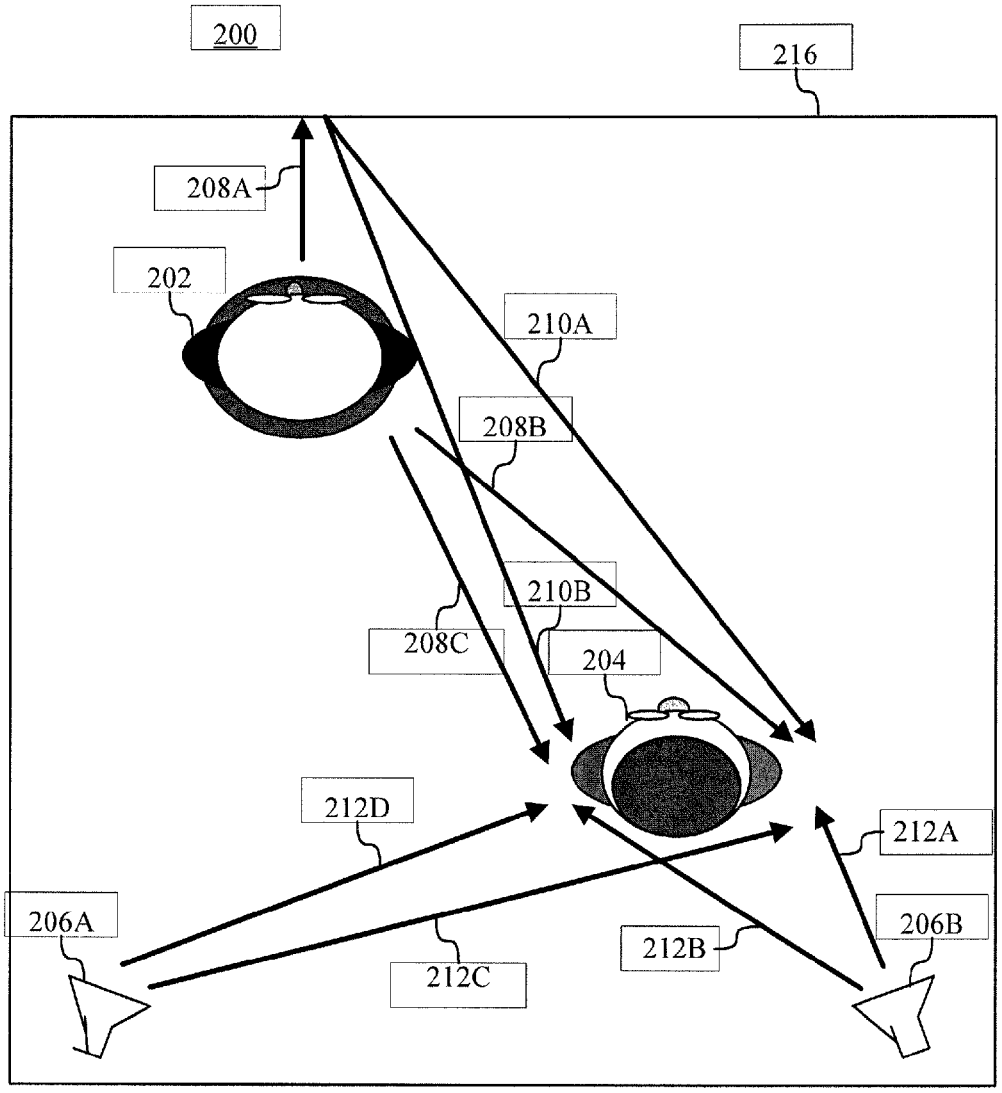
FIG. 2 is a further schematic representation of an overhead view of an automobile in which a system for speech reinforcement may be used.

FIG. 2 is a further schematic representation of an overhead view of an automobile in which a system for speech reinforcement may be used 200. The system 200 is an example system configuration for use in a vehicle. The example system configuration includes a driver, or an audio source 202, an occupant, or a listener 204, two or more audio transducers 206A and 206B (collectively or generically audio transducers 206) and a vehicle cabin, or an acoustic environment 216. An ICC system, not shown in FIG. 2, may capture an audio signal 208A, 208B and 208C (collectively or generically audio signals 208) generated by the audio source 202. The ICC system may reproduce the captured audio signal using the audio transducers 206. The audio signal 208 may be captured using one or more microphones 102, not shown in FIG. 2. The one or more microphones may be spatially located closer to the audio source 202 than to the listener 204. Audio signals 208A, 208B and 208C may be the same audio signal 208 generated by the audio source 202 but contain differing time/frequency content when perceived by the listener 204. For example, audio signal 208B and audio signal 208C may differ in relative time as perceived by the listener 204 due to different propagation delays. Audio signal 208C may be received in the left ear of the listener 204 before the audio signal 208B is received in the right ear of the listener 204. The time offset (difference) perceived between the two ears of the listener 204 may allow the listener 204 to spatially locate the audio source 202 relative to the listener 204.

Audio signal 208A may be reflected by physical surfaces including, for example, the dashboard and the windshield in an automobile. The reflection of audio signal 208A may include reflected audio signals 210A and 210B (collectively or generically reflected audio signals 210). The reflected audio signals 210 may be characterized as reverberations and/or echoes of the audio signal 208. The reflected audio signals 210 may help the listener 204 spatially locate the audio source 202 in a way similar to that for audio signal 208B and 208C as described above.

The audio transducers 206 may be used to reinforce the captured audio signal to facilitate communication between the audio source 202 and the listener 204. The listener 204 may receive reinforcement audio signals 212C and 212D from audio transducer 206A. The reinforcement audio signals 212C and 212D may have differences in time and/or frequency as perceived by the listener 204 due to the acoustic environment and propagation delays between the audio transducer 206A and the left and right ears of the listener 204. The listener 204 may receive the reinforcement audio signal 212A and 212B from audio transducer 206B. The reinforcement audio signals 212A and 212B may have differences in time and/or frequency as perceived by the listener 204 due to the acoustic environment and propagation delays between the audio transducer 206B and the left and right ears of the listener 204. The listener 204 may perceive the reinforcement signals 212A, 212B, 212C and 212D (collectively or generically reinforcement audio signals 212) to be spatially located behind the listener 204 because the reinforcement audio signals 212 are emitted from the audio transducers 206 that are spatially located behind the listener 204. The listener 204 may perceive the spatial location of the audio signal 208 to be generated by the audio source 202 in front of the listener 204 and the spatial location of the reinforcement signals 212 to be generated from behind the listener 204. This may be distracting and sound unnatural to the listener 204.

Figure 3:
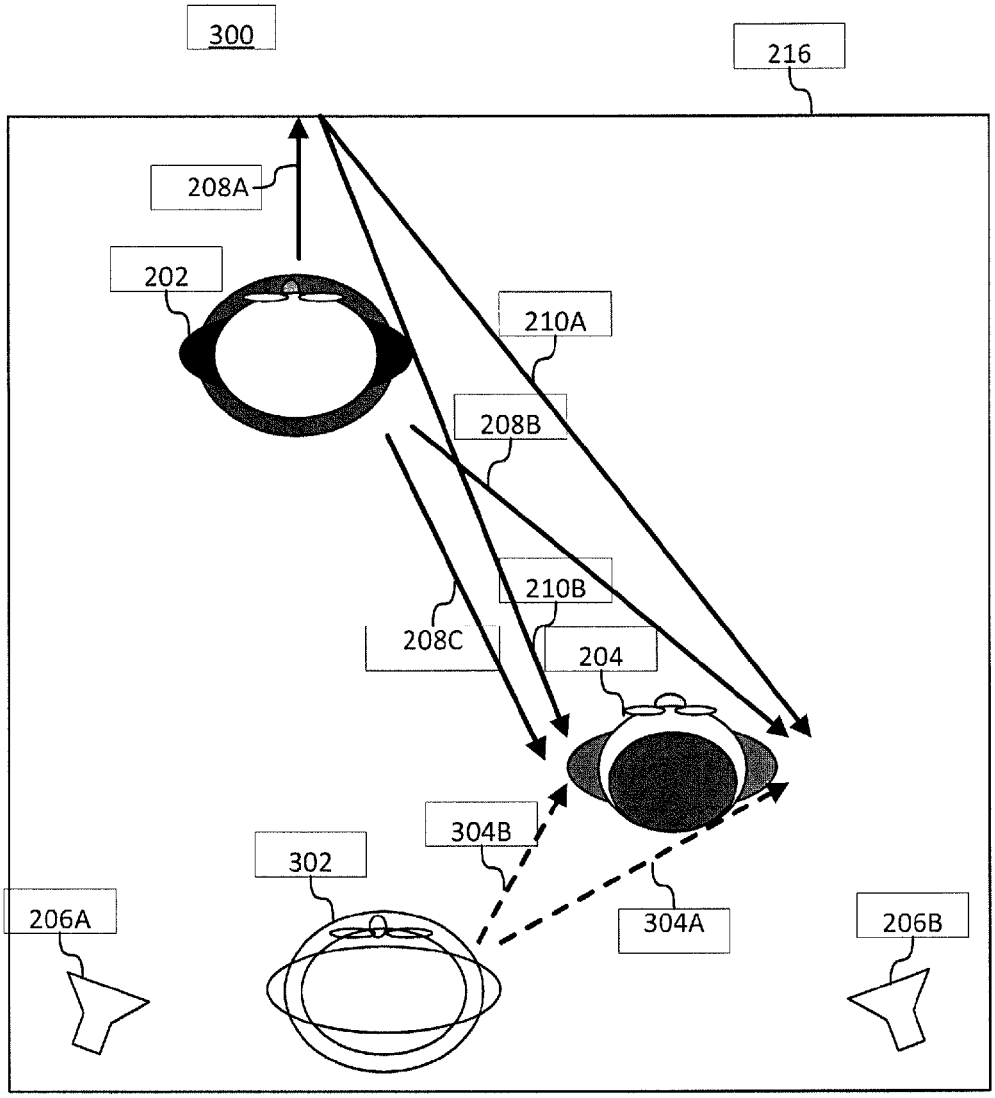
FIG. 3 is a further schematic representation of an overhead view of an automobile in which a system for speech reinforcement may be used.

FIG. 3 is a further schematic representation of an overhead view of an automobile in which a system for speech reinforcement may be used 300. The system 300 is an example system configuration for use in a vehicle that is the same as FIG. 2. The example system 300 shows how the listener 204 may spatially perceive the reinforcement signals 212 shown in FIG. 2. The listener 204 may perceive the reinforcement signals 212 as spatial reinforcement signals 304A and 304B (collectively or generically spatial reinforcement signals 304). The combination of the reinforcement signals 212A and 212C in the right ear of the listener 204 may be perceived as the spatial reinforcement signal 304A. In the same way, the combination of the reinforcement signal 212B and 212D in the left ear of the listener 204 may be perceived as the spatial reinforcement signal 304B. Since the spatial reinforcement signals 304 are generated behind the listener 204, the listener 204 may perceive the spatial reinforcement signals 304 to be generated by a virtual source 302 spatially located behind the listener 204.

Figure 4:
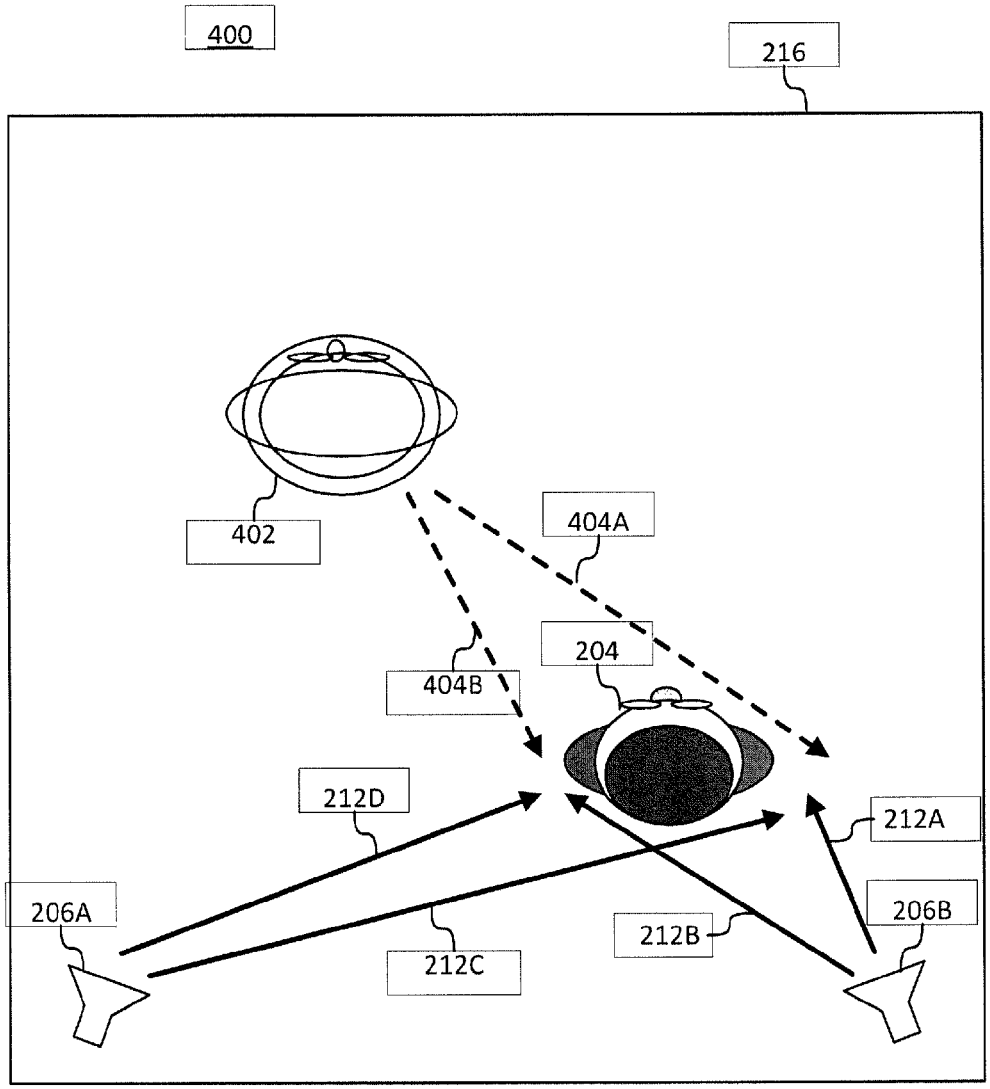
FIG. 4 is a further schematic representation of an overhead view of an automobile in which a system for speech reinforcement may be used.

FIG. 4 is a further schematic representation of an overhead view of an automobile in which a system for speech reinforcement may be used 400. The system 400 is an example system configuration for use in a vehicle that uses similar reinforcement signals 212 as those shown in FIG. 2. The spatial location of the virtual source 302 shown in FIG. 3 may be undesirable since the listener 204 may perceive the spatial location of the audio source 202 and the virtual audio source 302 to be in two different spatial locations. Processing may be applied to the captured audio signal that may allow the listener 204 to perceive spatial reinforcement signals 404A and 404B (collectively or generically spatial reinforcement signals 404) to be generated by a virtual source 402 spatially located in substantially the spatial location of the audio source 202. The processing may be responsive to the spatial location of the audio source 202, the spatial location of the listener 204 and the spatial location of the two or more audio transducers 206 to generate the reinforcing audio signal, or audio reinforcement signals 212.

The spatial location of a vehicle occupant may be determined in a variety of ways including, for example, sensors placed in each of the seating locations, audio processing of captured microphone signals that may track spatial location of audio signal 208, video cameras that support tracking motion inside the car, facial recognition, capturing heat signatures of occupants and other similar detection mechanisms. The vehicle occupants may include the audio source 202 and the listener 204. The spatial location of the audio transducers 206 may be known a priori or determined dynamically. Audio transducers 206 in an automobile may typically be spatially located in fixed locations. The captured audio signal may be processed in order for the listener 204 to perceive the reinforcement signals 212 to be generated by a virtual source 402 spatially located in substantially the spatial location of the audio source 202.

Processing (e.g. filtering) the captured audio signals reproduced as the reinforcement signals 212 in the two or more audio transducers 206 may be used to modify the spatial location of the virtual source 402 perceived by the listener 204. The processing applied to the captured audio signals emitted by the first audio transducer 206A may combine the desired spatial reinforcement signal 404B of the virtual source 402 and cancel the cross reinforcement signal 212B from the second audio transducer 206B in the left ear of the listener 204. The desired spatial reinforcement signal 404B associated with the virtual source 402 may be represented as a transfer function from the virtual source 402 to the left ear of the listener 204. The processing applied to the captured audio signals emitted by the first audio transducer 206A may be described as the convolution of the transfer function of the desired spatial reinforcement signal 404B and the inverse of the transfer function of the cross reinforcement signal 212B. Correspondingly, the filtering applied to the captured audio signals emitted by the second audio transducer 206B may be described as the convolution of the transfer function of the desired spatial signal 404A and the inverse of the transfer function of the cross reinforcement signal 212C. An example transfer function for the audio transducers 206 is shown in the following equations:

$$h_{206A}=h_{404B}\otimes h_{212B}^{-1}$$

$$h_{206B}=h_{404A}\otimes h_{212C}^{-1}$$

Processing the captured audio signal with the transfer function $h_{206A}$ and emitting the resultant signal from the audio transducer 206A may allow the listener 204 to perceive the desired spatial reinforcement signal 404B in the left ear. Filtering the captured audio signal with the transfer function $h_{206B}$ and emitting the resultant signal from the audio transducer 206B may allow the listener 204 to perceive the desired spatial reinforcement signal 404A in the right ear. The combination of the reinforcement signals 404A and 404B may allow the listener 204 to perceive the spatial location of the audio source to be that of the virtual source 402.

Calculating the transfer functions for the desired spatial signals, $h_{404A}$ and $h_{404B}$, and the cross reinforcement signals, $h_{212B}$ and $h_{212C}$, may be performed using, for example, any combination of theoretical or acoustic measurement techniques. One example theoretical calculation may create transfer functions that account for the propagation delay between the sources, the virtual source 402 and the audio transducers 206, and the spatial location of the listener 204. For example, the cross reinforcement signal 212B may have a propagation delay measured in milliseconds (msec) from the location of the audio transducer 206A to the right ear of the listener 204. The cross reinforcement signal 212C may have a propagation delay measured in msec from the location of the audio transducer 206B to the left ear of the listener 204. The desired spatial reinforcement signal 404A may have a propagation delay measured in msec from the location of the virtual source 402 to the right ear of the listener 204. The desired spatial reinforcement signal 404B may have a propagation delay measured in msec from the location of the virtual source 402 to the left ear of the listener 204. Each of the transfer functions may be created as a delayed impulse. The spatial location of the listener 204 may be an approximate spatial location as the listener 204 may move. For example, a sensor in the seat may determine that a listener 204 may be in the seating location but the exact position of the listeners' ears may be unknown. Any approximation error associated with creating the transfer function may result in a different perceived spatial location of the virtual source 402.

The transfer functions may include additional processing, or filtering, that may improve the accuracy of the perceived spatial location of the virtual source 402 including, for example, head shadowing effects, the acoustic environment of the car, shadowing effects of other listeners, orientation of the listener and the height of the listener. Microphones 102 located proximate to a listener 204 may be utilized to implement an adaptive filter that may improve the perceived spatial location of the virtual source 402.

In some situations, multiple listeners 204 may perceive the virtual source 402 from the same audio transducers 206. For example, two listeners 204 in the rear seat with a single driver, or audio source 202. The calculation of the transfer functions may utilize an average spatial location of the two listeners 204. The result of using an average spatial location of the two listeners 204 may cause each listener 204 to perceive the spatial location of the virtual source 402 to be in the front seat but not necessarily in the location of audio source 202. Each listener 204 may perceive the virtual audio source 402 to be in a different location. Even though the perceived spatial location of the virtual source 402 may not be in substantially the spatial location of the audio source 202, the overall perception of the listeners 204 may still be an improvement over the perception that the spatial reinforcement signals 304 are located behind the listener 204.

Figure 5:
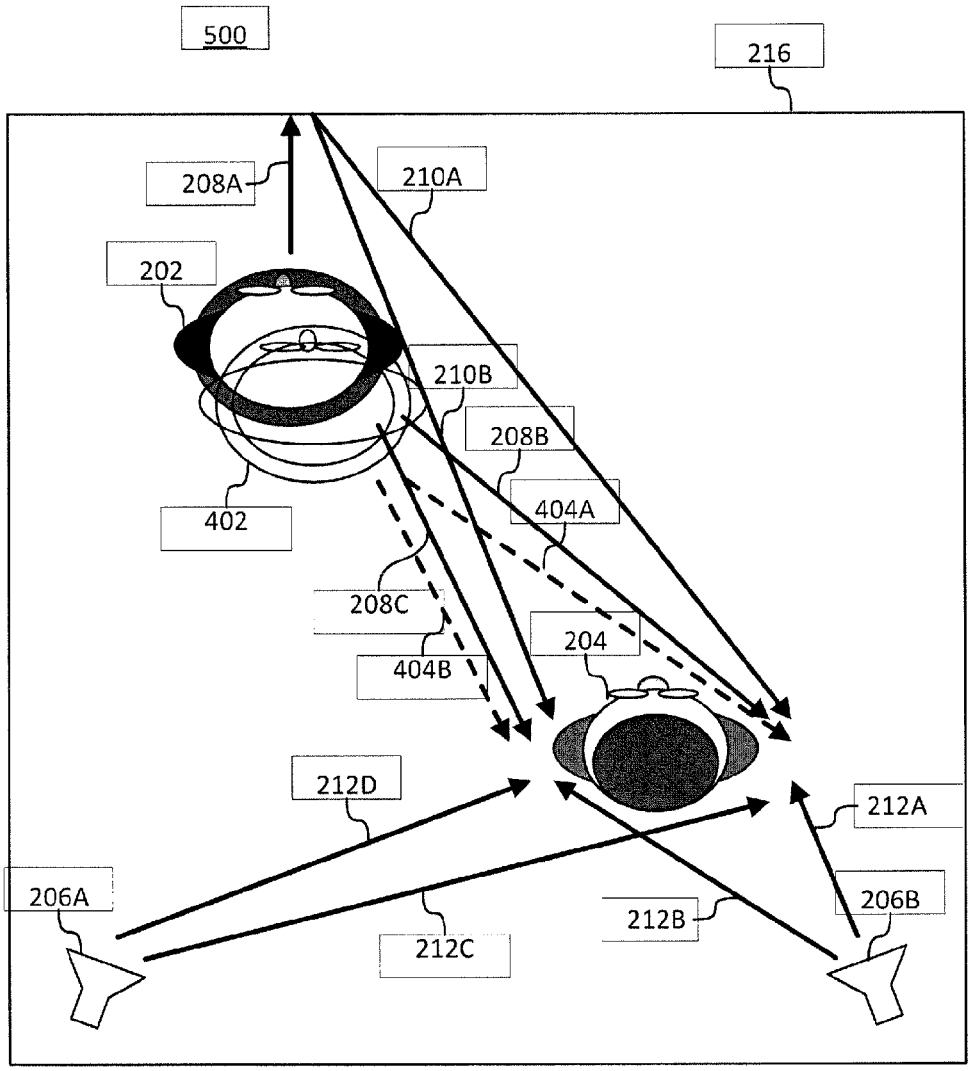
FIG. 5 is a further schematic representation of an overhead view of an automobile in which a system for speech reinforcement may be used.

FIG. 5 is a further schematic representation of an overhead view of an automobile in which a system for speech reinforcement may be used 500. The system 500 is an example system configuration for use in a vehicle that includes FIG. 4, the audio source 202, the audio signal 208 and the reflected audio signals 210. The audio source 202 and the virtual audio source 402 may be perceived by the listener 204 to be in substantially the same spatial location.

Figure 6:
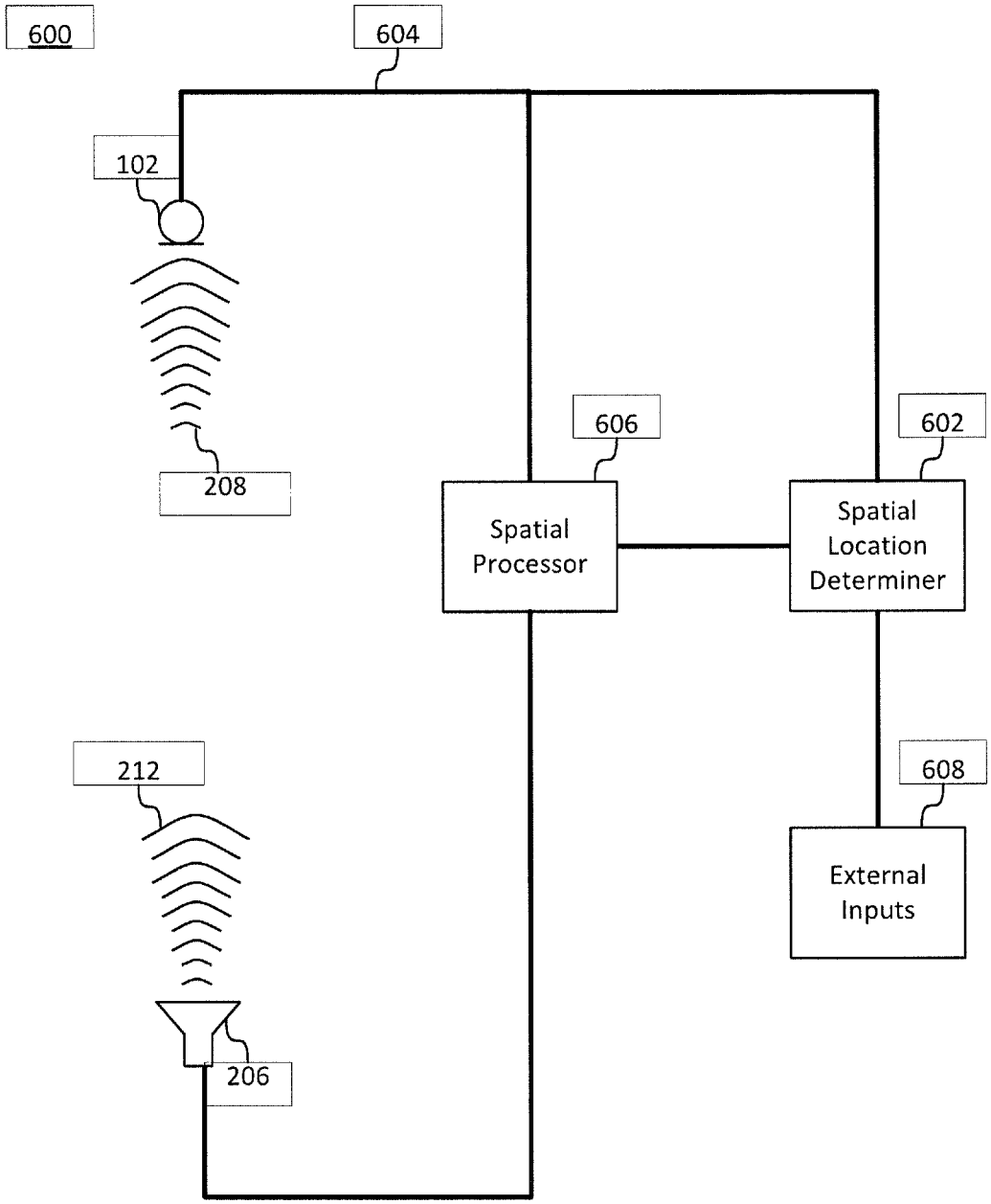
FIG. 6 is a schematic representation of a system for speech reinforcement.

FIG. 6 is a schematic representation of a system for speech reinforcement. The system 600 is an example system for use in a vehicle. The example system configuration includes one or more microphones 102, two or more audio transducers 206, a spatial location determiner 602, and a spatial processor 606. The one or more microphones 102 may capture the audio signal 208 associated with the audio source 202, not shown in FIG. 6, creating one or more captured audio signal 604. The spatial location determiner 602 may determine the spatial location of the audio source 202, the spatial location of the one or more listeners 204 and the spatial location of the two or more audio transducers 206. The spatial location determiner 602 may utilize external inputs 608 and the one or more captured audio signals 604 as described above to determine the relative spatial locations. The external inputs 608 may include, for example, seat sensor inputs and the result of camera based motion processing. The spatial processor 606 may calculate a filter function using the spatial location information derived by the spatial location determiner 602 as described above. The spatial processor may filter the captured audio signal 604. The processed audio signal may be emitted using the two or more audio transducers 206 to produce the audio reinforcement signals 212.

Figure 7:
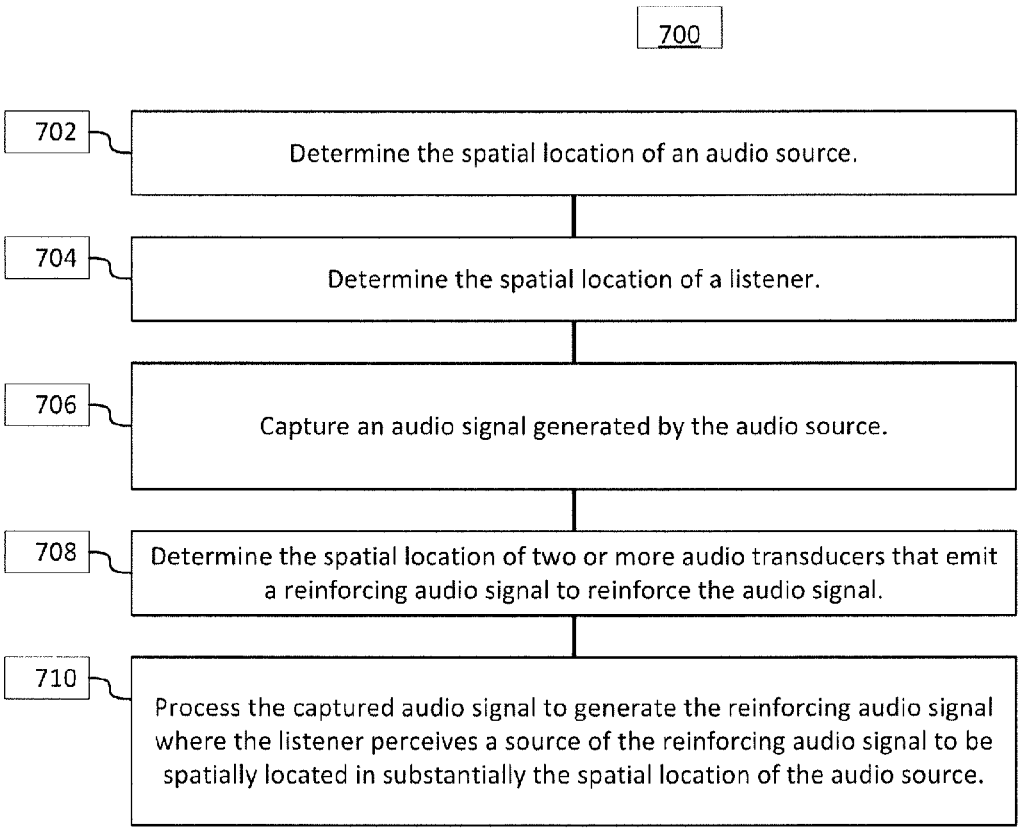
FIG. 7 is a representation of a method for speech reinforcement.

FIG. 7 is a representation of a method for speech reinforcement. The method 700 may be, for example, implemented using any of the systems 100, 400, 500, 600 and 800 described herein with reference to FIGS. 1, 4, 5, 6 and 8. The method 700 includes the following acts. Determining the spatial location of an audio source 702 and determining the spatial location of a listener 704. The determined locations may be represented in an absolute or a relative frame of reference. Capturing an audio signal generated by the audio source 706. Determining the spatial location, relative to the listener, of two or more audio transducers that emit a reinforcing audio signal to reinforce the audio signal 708. Processing the captured audio signal, responsive to the spatial location of the audio source, the spatial location of the listener and the spatial location of the two or more audio transducers used to generate the reinforcing audio signal, such that, when emitted by the two of more audio transducers, the listener perceives a source of the reinforcing audio signal to be spatially located in substantially the spatial location of the audio source thereby reinforcing the audio signal 710.

One or more ICC systems using speech reinforcement may be operated concurrently. The example systems described above show the driver as the audio source 202 communicating with one or more listeners 204 behind the driver. The driver may also be the listener 204 and the passengers behind the driver may become the audio source 202. In another example, a third row of seats in a vehicle cabin may include an ICC system with speech reinforcement to communicate with all the other vehicle occupants.

Figure 8:
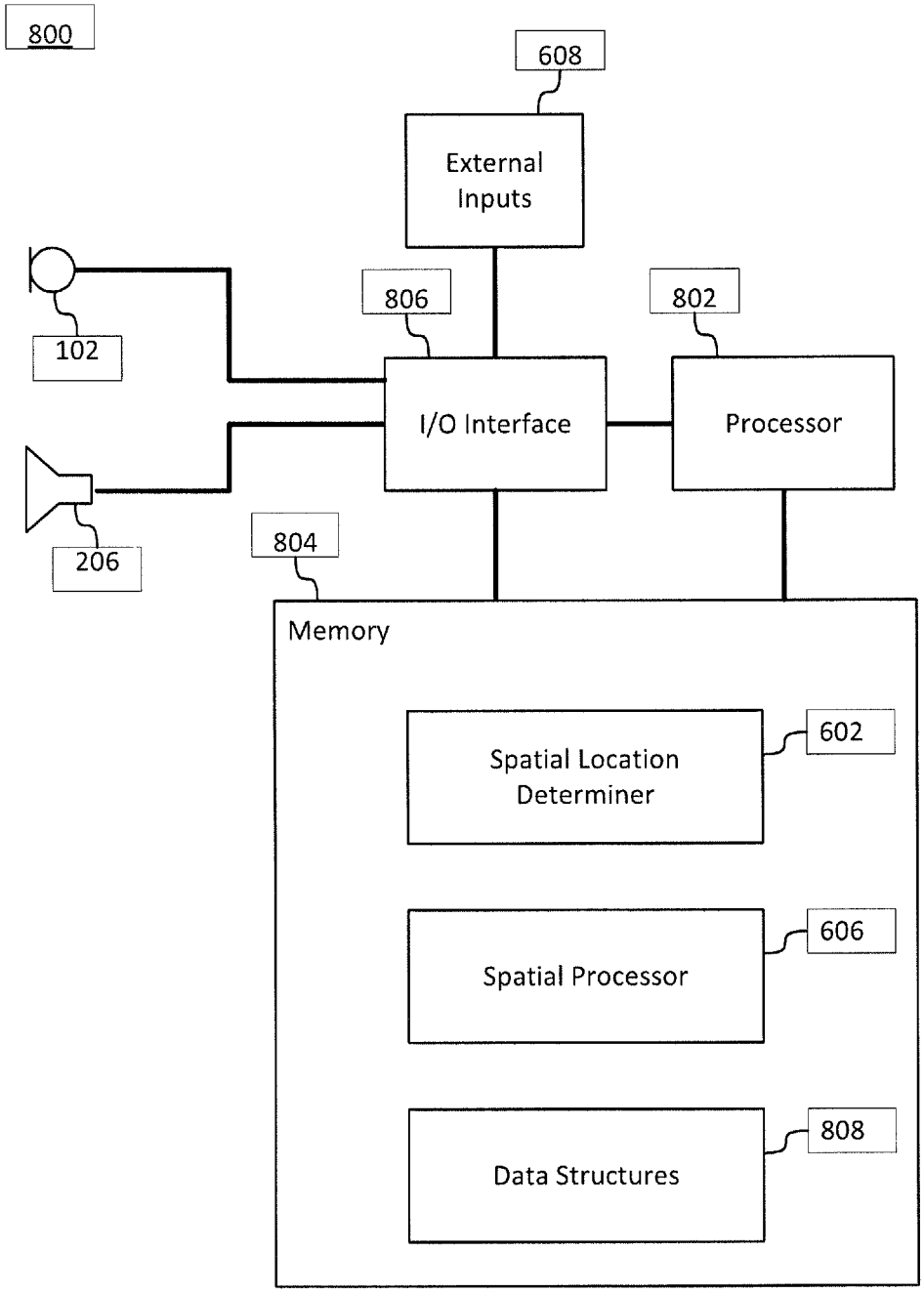
FIG. 8 is a further schematic representation of a system for speech reinforcement.

FIG. 8 is a further schematic representation of a system for speech reinforcement. The system 800 comprises a processor 802, memory 804 (the contents of which are accessible by the processor 802) and an I/O interface 806. The memory 804 may store instructions which when executed using the process 802 may cause the system 800 to render the functionality associated with speech reinforcement as described herein. For example, the memory 804 may store instructions which when executed using the processor 802 may cause the system 800 to render the functionality associated with the spatial location determiner 602 and the spatial processor 606 as described herein. In addition, data structures, temporary variables and other information may store data in data storage 808.

The processor 802 may comprise a single processor or multiple processors that may be disposed on a single chip, on multiple devices or distributed over more that one system. The processor 802 may be hardware that executes computer executable instructions or computer code embodied in the memory 804 or in other memory to perform one or more features of the system. The processor 802 may include a general purpose processor, a central processing unit (CPU), a graphics processing unit (GPU), an application specific integrated circuit (ASIC), a digital signal processor (DSP), a field programmable gate array (FPGA), a digital circuit, an analog circuit, a microcontroller, any other type of processor, or any combination thereof.

The memory 804 may comprise a device for storing and retrieving data, processor executable instructions, or any combination thereof. The memory 804 may include non-volatile and/or volatile memory, such as a random access memory (RAM), a read-only memory (ROM), an erasable programmable read-only memory (EPROM), or a flash memory. The memory 804 may comprise a single device or multiple devices that may be disposed on one or more dedicated memory devices or on a processor or other similar device. Alternatively or in addition, the memory 804 may include an optical, magnetic (hard-drive) or any other form of data storage device.

The memory 804 may store computer code, such as the spatial location determiner 602 and the spatial processor 606 as described herein. The computer code may include instructions executable with the processor 802. The computer code may be written in any computer language, such as C, C++, assembly language, channel program code, and/or any combination of computer languages. The memory 804 may store information in data structures including, for example, feedback coefficients.

The I/O interface 806 may be used to connect devices such as, for example, the microphones 102, the audio transducers 206, the external inputs 608 and to other components of the system 800.

All of the disclosure, regardless of the particular implementation described, is exemplary in nature, rather than limiting. The system 800 may include more, fewer, or different components than illustrated in FIG. 8. Furthermore, each one of the components of system 800 may include more, fewer, or different elements than is illustrated in FIG. 8. Flags, data, databases, tables, entities, and other data structures may be separately stored and managed, may be incorporated into a single memory or database, may be distributed, or may be logically and physically organized in many different ways. The components may operate independently or be part of a same program or hardware. The components may be resident on separate hardware, such as separate removable circuit boards, or share common hardware, such as a same memory and processor for implementing instructions from the memory. Programs may be parts of a single program, separate programs, or distributed across several memories and processors.

The functions, acts or tasks illustrated in the figures or described may be executed in response to one or more sets of logic or instructions stored in or on computer readable media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing, distributed processing, and/or any other type of processing. In one embodiment, the instructions are stored on a removable media device for reading by local or remote systems. In other embodiments, the logic or instructions are stored in a remote location for transfer through a computer network or over telephone lines. In yet other embodiments, the logic or instructions may be stored within a given computer such as, for example, a CPU.

While various embodiments of the system and method system and method for speech reinforcement, it will be apparent to those of ordinary skill in the art that many more embodiments and implementations are possible within the scope of the present invention. Accordingly, the invention is not to be restricted except in light of the attached claims and their equivalents.

The claims are as follows:

1. A method for speech reinforcement comprising:

determining, by a processor, a spatial location of an audio source;

determining, by the processor, a spatial location of a listener;

capturing an audio signal generated by the audio source;

determining, by the processor, a spatial location, relative to the listener, of two or more audio transducers that emit a reinforcing audio signal to reinforce the audio signal; and processing, by the processor, the captured audio signal, responsive to the spatial location of the audio source, the spatial location of the listener, and the spatial location of the two or more audio transducers, to generate the reinforcing audio signal wherein, when emitted by the two of more audio transducers, the listener perceives a source transmitting the reinforcing audio signal to be spatially located in substantially the same spatial location of the audio source; and wherein the processor convolves a transfer function of a desired spatial reinforcement signal with an inverse transfer function of a cross reinforcement signal.

2. The method for speech reinforcement of claim 1, wherein the captured audio signals include one or more of: voices from persons in an automobile cabin, voices from persons in a conference room, time-delayed and reverberant energy associated with the audio signals, music from an integrated entertainment system, alerts associated with vehicle functionality or noise.

3. The method for speech reinforcement of claim 1, wherein determining the spatial location is based on one or more of: a priori knowledge of spatial location, output from sensors placed in a seat location, audio processing of the captured audio signals that track spatial location of the audio source, video that supports tracking motion, facial recognition, and heat signatures.

4. The method for speech reinforcement of claim 1, wherein the processing applied to the captured audio signal emitted by a second audio transducer of the two or more audio transducers combines a convolution of a transfer function of a second desired spatial reinforcement signal and a convolution of an inverse of a transfer function of a second cross reinforcement signal.

5. The method for speech reinforcement of claim 4, wherein the transfer function is calculated using one or more of: theoretical measurement techniques and acoustic measurement techniques.

6. The method for speech reinforcement of claim 5, wherein calculating the transfer function of the desired spatial reinforcement signal is based on: head shadowing effects, an acoustic environment of the automobile cabin, shadowing effects of other listeners, an orientation of a listener and a height of the listener.

7. The method for speech reinforcement of claim 5, where calculating the transfer function of the desired spatial reinforcement signal is based on an average spatial location of a plurality of listeners.

8. The method for speech reinforcement of claim 5, wherein calculating the transfer function of the desired spatial reinforcement signal is based on an approximate spatial location of the listener.

9. The method for speech reinforcement of claim 1, wherein the processing applied to the captured audio signal emitted by the first audio transducer combines the desired spatial reinforcement signal and cancels the cross reinforcement signal.

10. The method for speech reinforcement of claim 9, wherein the processing applied to the captured audio signal emitted by the second audio transducer combines the desired spatial reinforcement signal and cancels the cross reinforcement signal from the first audio transducer.

11. The method for speech reinforcement of claim 1, wherein the audio source is captured utilizing one or more microphones spatially located closer to the audio source than to the spatial location of the listener.

12. A system for speech reinforcement comprising:

a spatial location determiner for determining the spatial location of an audio source;

the spatial location determiner for determining the spatial location of a listener;

an audio signal capturer for capturing an audio signal generated by the audio source;

the spatial location determiner for determining the spatial location, relative to the listener, of two or more audio transducers that emit a reinforcing audio signal to reinforce the audio signal; and a spatial processor for processing the captured audio signal responsive to the spatial location of the audio source, the spatial location of the listener and the spatial location of the two or more audio transducers to generate the reinforcing audio signal where, when emitted by the two of more audio transducers, the listener perceives a source of the reinforcing audio signal to be spatially located in at substantially the same spatial location of the audio source;

where the spatial processor convolves a transfer function of a desired spatial reinforcement signal with an inverse transfer function of a cross reinforcement signal.

13. The system for speech reinforcement of claim 12, wherein the audio signal capturer is configured to capture one or more of: voices from persons in an automobile cabin, voices from persons in a conference room, time-delayed and reverberant energy associated with the audio signals, music from an integrated entertainment system, alerts associated with vehicle functionality or noise.

14. The system for speech reinforcement of claim 12, wherein determining the spatial location is based on one or more of: a priori knowledge of spatial location, output from sensors placed in a seat location, audio processing of the captured audio signals that may track spatial location of the audio source, video that supports tracking motion, facial recognition, and capturing heat signatures.

15. The system for speech reinforcement of claim 12, wherein the processing applied to the captured audio signal emitted by a second audio transducer of the two or more audio transducers combines a convolution of a transfer function of a second desired spatial reinforcement signal and a convolution of an inverse of a transfer function of a second cross reinforcement signal.

16. The system for speech reinforcement of claim 15, wherein the transfer function of the desired spatial reinforcement signal is calculated by processing one or more of: theoretical measurement techniques and acoustic measurement techniques.

17. The system for speech reinforcement of claim 16, wherein the transfer function of the desired spatial reinforcement signal is based on: head shadowing effects, an acoustic environment of an automobile cabin, shadowing effects of other listeners, an orientation of the listener, and a height of the listener.

18. The system for speech reinforcement of claim 16, wherein the transfer function of the desired spatial reinforcement signal is based on an average spatial location of a plurality of listeners.

19. The system for speech reinforcement of claim 16, wherein the transfer function of the desired spatial reinforcement signal is based on an approximate spatial location of the listener.

20. The system for speech reinforcement of claim 12, wherein the processing applied to the captured audio signal emitted by the first audio transducer combines the desired spatial reinforcement signal and the cancels reinforcement signal.

21. The system for speech reinforcement of claim 20, wherein the processing applied to the captured audio signal emitted by the second audio transducer combines the desired spatial reinforcement signal and cancels the cross reinforcement signal from the first audio transducer.

22. The system for speech reinforcement of claim 12, wherein the audio source is captured utilizing one or more microphones spatially located closer to the audio source than to the spatial location of the listener.

23. A non-transitory machine readable medium encoded with machine-executable instructions, wherein execution of the machine-executable instructions is for:

determining, by a processor, a spatial location of an audio source;

determining, by the processor, a spatial location of a listener;

capturing an audio signal generated by the audio source;

determining, by the processor, a spatial location, relative to the listener, of two or more audio transducers that emit a reinforcing audio signal to reinforce the audio signal; and processing, by the processor, the captured audio signal, responsive to the spatial location of the audio source, the spatial location of the listener, and the spatial location of the two or more audio transducers, to generate the reinforcing audio signal wherein, when emitted by the two of more audio transducers, the listener perceives a source transmitting the reinforcing audio signal to be spatially located in substantially the same spatial location of the audio source; and wherein the processor convolves a transfer function of a desired spatial reinforcement signal with an inverse transfer function of a cross reinforcement signal.

24. The non-transitory machine readable medium of claim 23 wherein the captured audio signals include one or more of: voices from persons in an automobile cabin, voices from persons in a conference room, time-delayed and reverberant energy associated with the audio signals, music from an integrated entertainment system, alerts associated with vehicle functionality or noise.

25. The non-transitory machine readable medium of 23 wherein determining the spatial location is based on one or more of: a priori knowledge of spatial location, output from sensors placed in a seat location, audio processing of the captured audio signals that track spatial location of the audio source, video that supports tracking motion, facial recognition, and heat signatures.

26. The non-transitory machine readable medium of claim 23 wherein the processing applied to the captured audio signal emitted by a second audio transducer of the two or more audio transducers combines a convolution of a transfer function of a second desired spatial reinforcement signal and a convolution of an inverse of a transfer function of a second cross reinforcement signal.

27. The non-transitory machine readable medium of claim 26, wherein the transfer function is calculated based on one or more of: theoretical measurement techniques and acoustic measurement techniques.

28. The non-transitory machine readable medium of claim 27, wherein calculating the transfer function of the desired spatial reinforcement signal is based on: head shadowing effects, an acoustic environment of the automobile cabin, shadowing effects of other listeners, an orientation of a listener, and a height of the listener.

29. The non-transitory machine readable medium of claim 27, where calculating the transfer function of the desired spatial reinforcement signal is based on an average spatial location of two listeners.

30. The non-transitory machine readable medium of claim 27, wherein calculating the transfer function of the desired spatial reinforcement signal is based on an approximate spatial location of the listener.

31. The non-transitory machine readable medium of claim 23, wherein the processing applied to the captured audio signal emitted by the first audio transducer combines the desired spatial reinforcement signal and cancels the cross reinforcement signal.

32. The non-transitory machine readable medium of claim 31, wherein the processing applied to the captured audio signal emitted by the second audio transducer combines the desired spatial reinforcement signal and cancels the cross reinforcement signal from the first audio transducer.

33. The non-transitory machine readable medium of claim 23, wherein the audio source is captured utilizing one or more microphones spatially located closer to the audio source than to the spatial location of the listener.

* * * * *